United States Patent [19]

Langner

[11] Patent Number: 4,617,998

[45] **Date of Patent: * Oct. 21, 1986**

[54] DRILLING RISER BRAKING APPARATUS AND METHOD

[75] Inventor: Carl G. Langner, Spring, Tex.

[73] Assignee: Shell Oil Company, Houston, Tex.

[ * ] Notice: The portion of the term of this patent subsequent to Oct. 8, 2002 has been disclaimed.

[21] Appl. No.: 720,842

[22] Filed: Apr. 8, 1985

[51] Int. Cl.[4] ..... E21B 19/09

[52] U.S. Cl. ..... 166/345; 166/353; 166/355; 166/367

[58] Field of Search ..... 166/345, 352–355, 166/362, 367; 188/67; 248/316.4, 316.3, 316.2, 316.1, 231.3, 231.4, 410, 414, 561; 81/57.16, 57.34, 59.36, 57.2; 285/96

[56] References Cited

U.S. PATENT DOCUMENTS

| | | | |
|---|---|---|---|
| 3,717,002 | 2/1973 | O'Brien et al. | 166/345 |
| 3,771,389 | 11/1973 | Goyne | 81/57.16 |
| 3,860,270 | 1/1975 | Arnold | 285/96 |
| 4,456,070 | 6/1984 | Watkins | 166/345 |
| 4,527,817 | 7/1985 | Persson | 285/96 |
| 4,545,437 | 10/1985 | Denison | 166/345 |

*Primary Examiner*—Stephen J. Novosad
*Assistant Examiner*—William P. Neuder
*Attorney, Agent, or Firm*—Paul I. Douglas

[57] ABSTRACT

Method and apparatus for use in drilling a well from a floating vessel by means of a riser which connects the vessel's drilling equipment to a wellhead assembly adjacent the ocean floor. Braking apparatus is provided which is capable of arresting the vertical motions of the drilling riser and of securing the upper end of the riser to the vessel whenever the riser is disconnected from the wellhead.

37 Claims, 13 Drawing Figures

10
42
50
54
52
53
72
71
31
49
48
2A
70
73
2A
41
40
43
55
51

31
10
7
60
61
49
48
42
56
57
52
53
44
40
41
45

FIG. 4
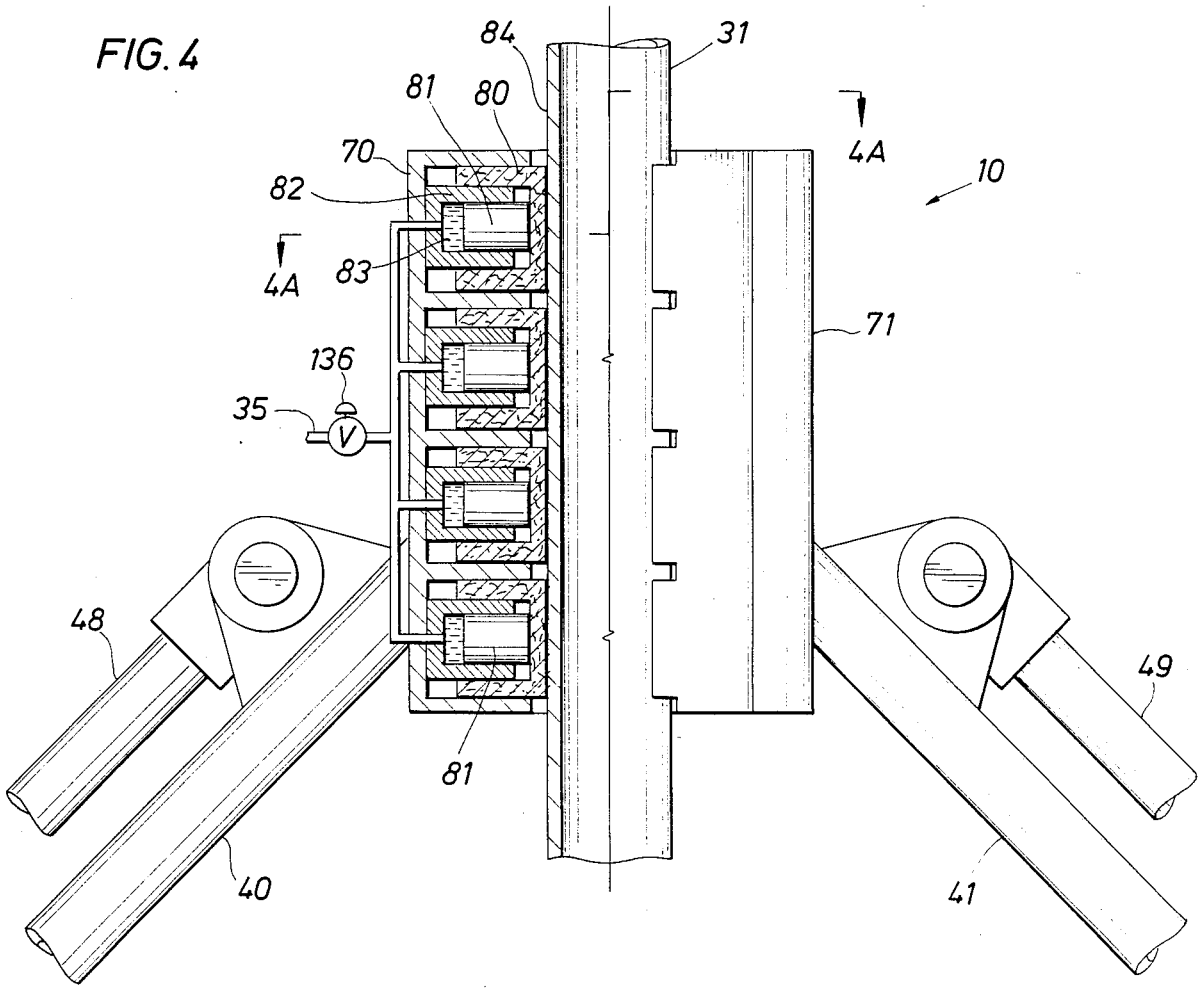
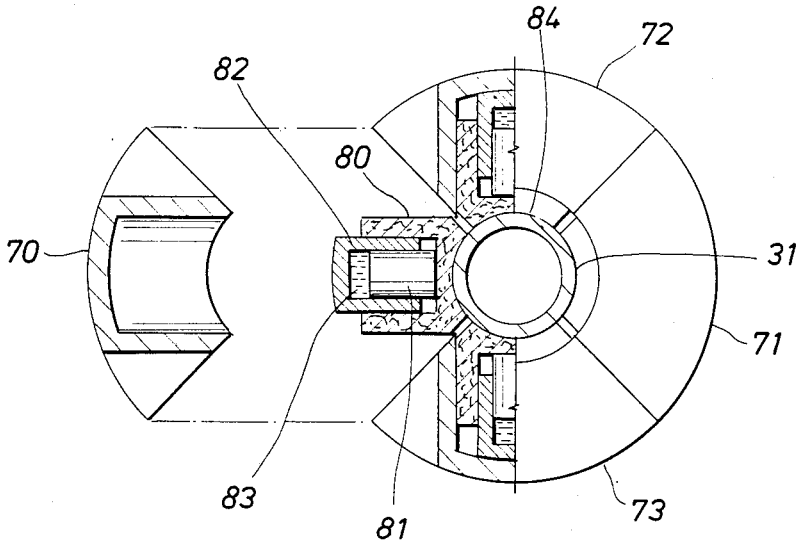
FIG. 4A

FIG. 6
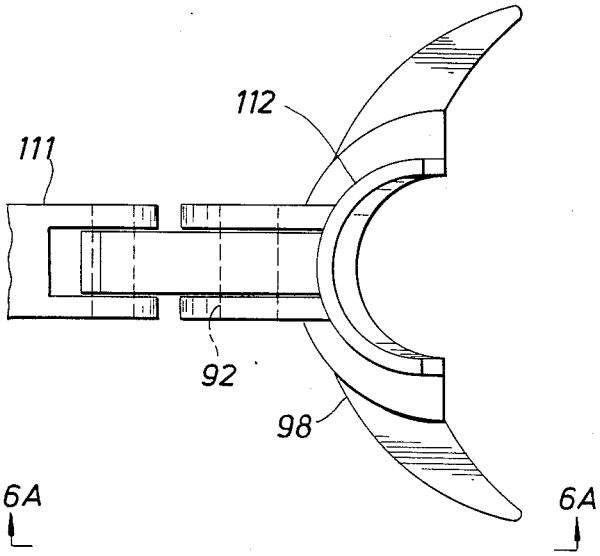
FIG. 5
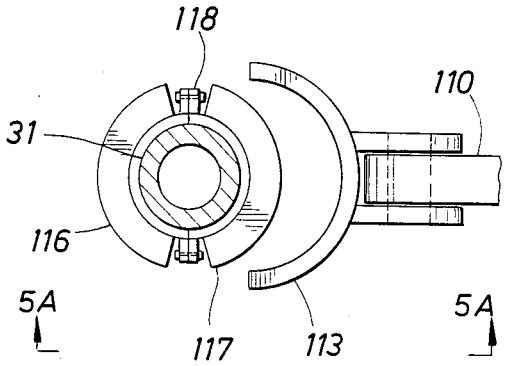
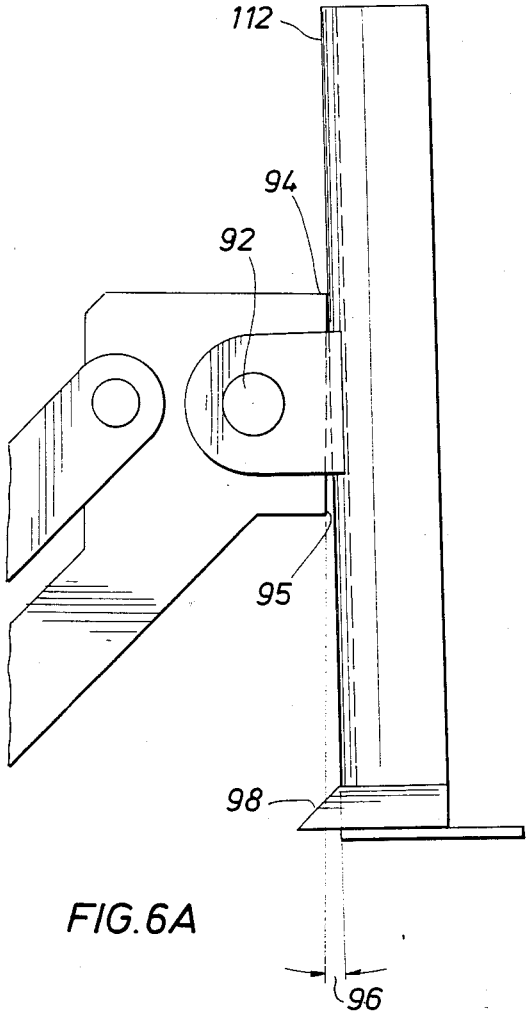
FIG. 6A
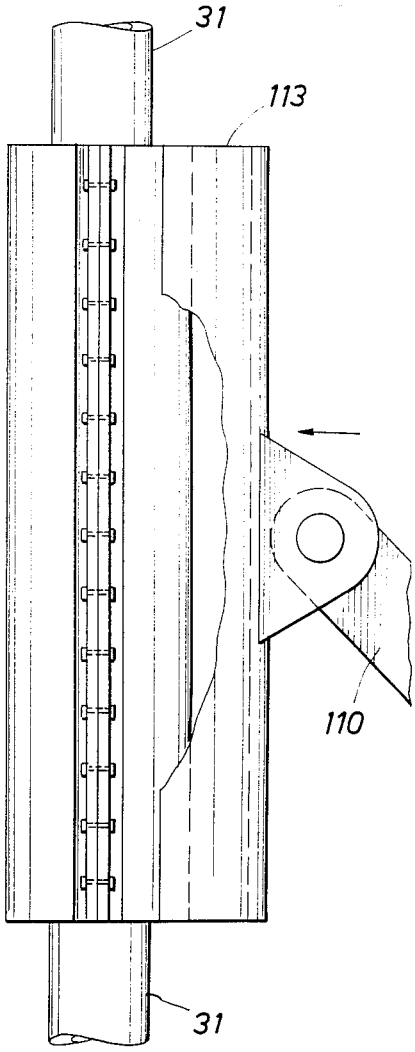
FIG. 5A

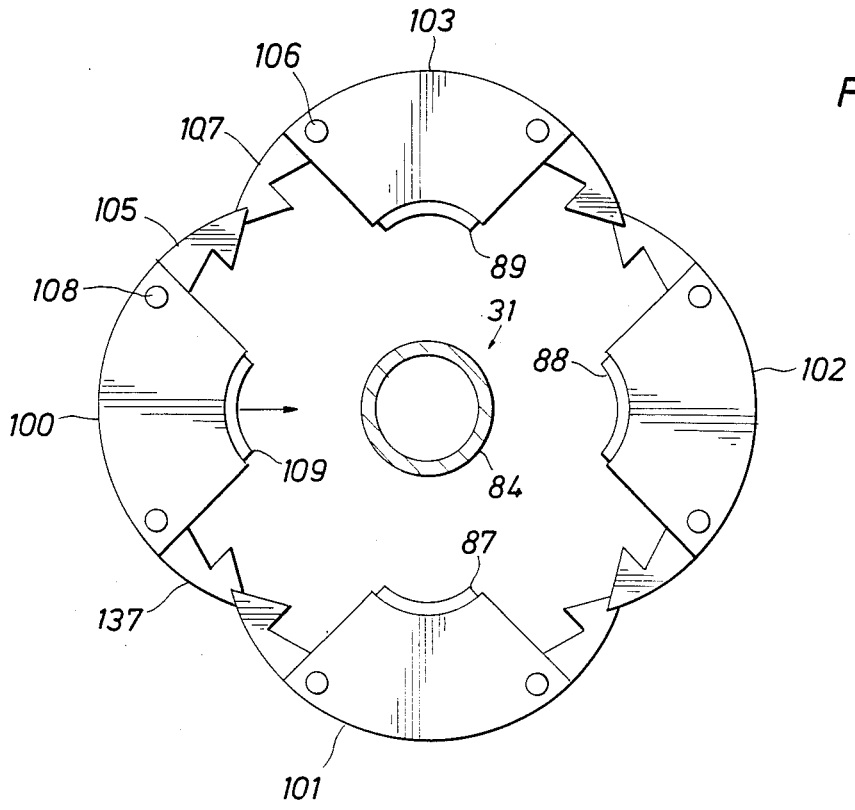
FIG. 7
FIG. 8
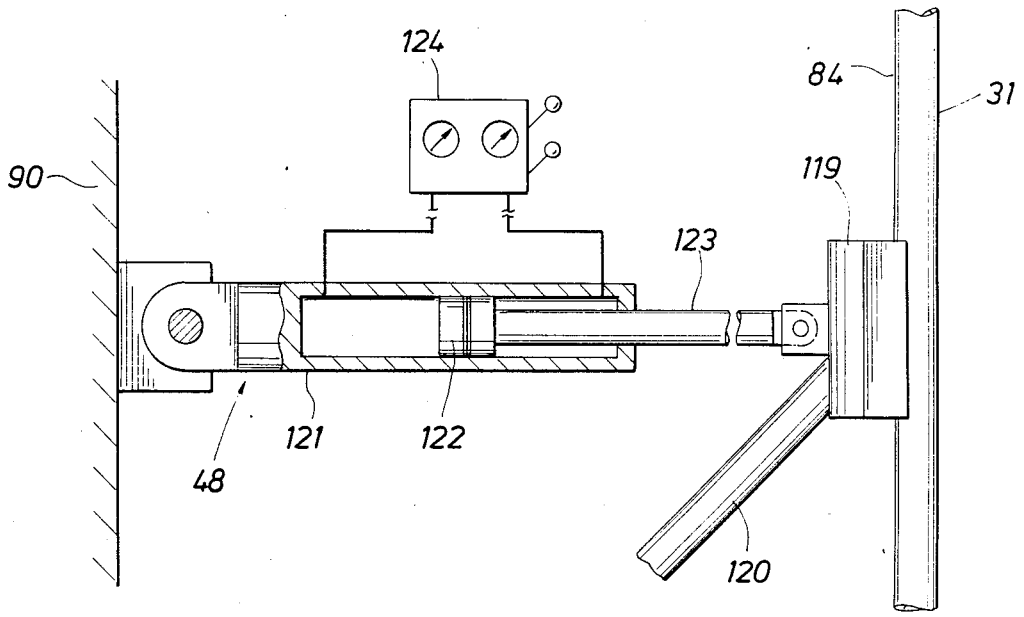

DRILLING RISER BRAKING APPARATUS AND METHOD

RELATED APPLICATION

This application is related to two copending applications, both entitled "Drilling Riser Locking Apparatus and Method", Ser. Nos. 597,994 and 597,995, both filed Apr. 9, 1984 now U.S. Pat. Nos. 4,545,437 and 4,557,332.

BACKGROUND OF THE INVENTION

1. Field of the Invention

The present invention relates to apparatus and method for drilling a well into earth formations lying below a body of water, wherein the wellhead equipment of the well is positioned below the surface of the water. The well is drilled from a floating drilling vessel, with a riser conduit connecting the vessel drilling equipment to the wellhead assembly.

2. Description of the Prior Art

An increasing amount of offshore deepwater exploratory well drilling is being conducted in an attempt to locate oil and gas reservoirs. These exploratory wells are generally drilled from floating vessels. As in any drilling operation, drilling fluid must be circulated through the drillbit in order to cool the bit and to carry away the cuttings. This drilling fluid is normally returned to the floating vessel by means of a large diameter pipe, known as a riser, which extends between the subsea wellhead assembly and the floating vessel. The lower end of this riser is connected to the wellhead assembly which is generally located adjacent to the ocean floor, and the upper end usually extends through a centrally located hull opening of the floating vessel. A drillstring extends downward through the riser into earth formations lying below the body of water, and drilling fluids circulate downwardly through the drillstring, out through the drilling bit, and then upwardly through the annular space between the drillstring and the riser, returning to the vessel.

As these drilling operations progress into deeper waters, the length of the riser and consequently its unsupported weight also increases. Since the riser has the same structural buckling characteristics as a vertical column, riser structural failure may result if compressive stresses in the elements of the riser exceed the metallurgical limitations of the riser material. Two separate mechanisms are typically used to avoid the possibility of this cause of riser failure.

Riser tensioning systems are installed onboard the vessel, which apply an upward force to the upper end of the riser, usually by means of cable, sheave, and pneumatic cylinder mechanisms connected between the vessel and the upper elements of the riser.

In addition, buoyancy or ballasting means may also be attached to the submerged portion of the riser. These usually are comprised of syntactic foam elements or individual ballast or buoyancy tanks formed on the outer surface of the riser sections. The ballast or buoyancy tanks are capable of being selectively inflated with air or ballasted with water by utilization of the floating vessel's air compression equipment. Both of these buoyancy devices create upwardly directed forces in the riser, thus compensating for the compressive stresses created by the riser's weight, and thereby preventing riser failure.

Since the riser is fixedly secured at its lower end to the wellhead assembly, the floating vessel will move relative to the upper end of the riser due to wind, wave, and tide oscillations normally encountered in the marine environment.

This creates a problem because the portion of the stationary riser located within the hull opening of the oscillating vessel can contact and damage the vessel, unless it remains safely positioned within the hull opening. For this reason motion compensating equipment incorporated with the riser tensioning system is used to steady the riser within the hull opening, and usually takes the form of pneumatically and/or hydraulically actuated cable and sheave mechanisms connectably engaged between the upper riser elements and the vessel structure, and a flexible coupling located in the riser adjacent the vessel's hull. This equipment allows the vessel to undergo moderate heave, pitch, roll, and sway motions without contacting the upper elements of the riser.

A floating drilling vessel maintains its position over a subsea well by means of a system of mooring lines and anchors, or a system of dynamic positioning thrusters, or a combination of mooring lines and thrusters. Such positioning systems compensate for normal current and wind loading, and prevent riser separation due to the vessel being pushed away from the wellhead location.

All of these systems, however, can only prevent riser compressive failure, separation, or contact with the vessel during normal sea state conditions. The capacity of these systems is exceeded with winds typically over 35 to 40 mph and/or swells over a height of 25 feet. Also, the vessel's dynamic positioning system is subject to failure without warning, which causes the vessel to "drive" off its normal position over the well. Under either of these conditions, measures need to be taken to prevent damage to the vessel and riser.

The riser may be disconnected from the wellhead and then disassembled in sections and stowed on the floating vessel's deck, but the time required for this operation usually exceeds the warning time given by an oncoming storm, and certainly would not be practical in the event of a positioning system failure.

The riser may be disconnected from the wellhead and then disassembled in sections and stowed on the floating vessel's deck, but the time required for this operation usually exceeds the warning time given by an oncoming storm, and certainly would not be practical in the event of a positioning system failure.

The riser may be disconnected from the wellhead assembly and then maintained suspended from the vessel. The vessel with the suspended riser then may remain in the vicinity of the wellhead assembly until conditions permit re-connection to the wellhead, or the vessel may attempt to tow the riser out of the path of an approaching storm. In either situation, once the riser's lower element is released from the wellhead assembly, the riser becomes a vertically oriented submerged vessel with its own oscillatory heave characteristics, or "bobbing" tendencies, typically different than those of the supporting vessel. When the riser, which may be under considerable tension from the tensioning system on the vessel, is released abruptly from the wellhead assembly, the riser will accelerate upward, with the result that the upward movement of the riser often may exceed the displacement limits of the riser tensioning system. Also, when the vessel and riser heave upward, due to the vessel riding the crest of a wave, the riser may continue upward while the vessel is falling downward in a subsequent wave trough. This uncontrolled upward and subsequent downward movement of the riser through the center of the hull opening can exceed the allowable vertical movement and load capacity of the normal motion compensating and tensioning equipment, thereby causing severe damage to the vessel and riser, with attendant risk to crew and vessel.

As described in two related copending applications, both entitled "Drilling Riser Locking Apparatus and Method", filed Apr. 9, 1984, apparatus is disclosed which locks the upper end of the drilling riser to the vessel. This eliminates the vertical and lateral movement of the riser relative to the vessel, obviating the above problem. The disclosed related apparatus is comprised of riser locking apparatus carried within the hull opening of the floating vessel adjacent the bottom of the vessel. The riser locking apparatus is carried at this lower elevation so that the angular displacement of the riser at its upper flexible coupling will not cause the riser, in its displaced position, to contact and damage the vessel's hull. The riser locking apparatus disclosed in both of these copending applications comprises a pair of movable beams that can be moved toward each other, at the closest point of travel engaging the upper elements of the riser. Locking these beams in their closed position effectively locks the upper end of the riser to the vessel.

In both of the copending applications, however, proper alignment of the riser with the locking beams in either the vertical or horizontal plane is necessary before the riser may be locked in position.

In copending application Ser. No. 597,994, vertical movement of the riser must be stopped before the movable beams can be closed. In copending application Ser. No. 597,995, the riser must be held in position in the center of the vessel's moon pool before the riser can be raised up between the movable beams and subsequently be latched in place.

In both situations oscillation of the riser must be dampened by devices other than the locking device, prior to the riser being locked in place. Riser positioning means separate from the oscillation dampening means must also be used. The operation of all of the above position and oscillation dampening equipment requires close coordination and concentration by the vessel's crew, often during times of adverse sea state conditions or in response to unexpected failure of the vessel's directional positioning system.

A device need be developed which combines the riser position and oscillation dampening functions in one device.

SUMMARY OF THE INVENTION

The present invention incorporates riser positioning means, oscillation dampening means, and riser locking means in one device. The combination of all of these riser control capabilities in one device greatly simplifies the securement of the riser to the vessel, since the vessel crew need only control one device to position, dampen the oscillations, and lock the riser's upper end to the vessel.

The present apparatus comprises brake element means carried by the vessel operatively engaged between the vessel and the riser's upper end to arrest and prevent further movement of the riser's upper end relative to the vessel, and brake element means prime mover means operatively connected between the vessel and the brake element means, for selectively moving the brake element means.

In operation, as the riser is being prepared for disconnection from the wellhead assembly, the brake elements of the present apparatus move toward the riser's upper end which has a riser brake section. This brake section which is incorporated into the riser's upper end, forms a contact area for the braking apparatus brake elements. Riser positioning means in the form of extension arms carried by the brake elements contact the riser's brake section and centralize the riser in the moon pool of the vessel. Further movement of the brake elements toward the riser causes the brake elements to contact the riser brake contact area, which is that portion of the riser brake section currently in contact with the brake elements. Friction generated between the brake elements and the riser brake contact area dampens the oscillations of the riser. Further pressure applied by the brake elements to the riser brake contact area arrests further movement of the riser and effectively locks the riser's upper elements to the vessel. Heat generated by friction during the braking process is dissipated into the surrounding ocean water, if the device is mounted below the waterline of the vessel. Or, the heat may be dissipated by auxilliary water cooling systems or by air-cooled brake elements.

One advantage of the present invention is that movements of the riser are at all times controllable and therefore no longer present a threat to the drilling vessel or its crew.

A further advantage of the present invention is that riser loads are carried into the ship's structure primarily by tension/compression stresses in the brake system's supporting beams, a result more efficient than the bending action of the beam structures disclosed in the two copending applications Ser. Nos. 597,994 and 597,995.

This invention may be used to safely transport the riser away from the current drilling location in order to avoid a marine storm environment, or it may be used to transport the riser from one wellhead location to another prior to performing further normal drilling operations, or it may be used to suspend the riser temporarily during maintenance operations on the vessel's motion compensating and riser tensioning equipment, or it may be used to suspend the riser from the vessel for an indeterminate length of time, either during normal operations or during an emergency disconnect.

Accordingly, it is an object of the invention to provide an offshore vessel with a riser braking apparatus which is capable of dampening any relative movements between the vessel and the riser, and then to securely lock the upper end of the riser to the vessel, thereby preventing relative motion between the upper end of the suspended riser and the vessel, whenever the riser is disconnected from the wellhead assembly on the seafloor. In the preferred embodiment, this riser braking apparatus includes braking elements carried adjacent to the end of movable braking beams which pivot about connection points mounted on the vessel. The present riser braking apparatus can therefore be maintained in a stowed position when not in use.

Another object is to provide a means of safe disconnection of a riser from a wellhead assembly, such that motions of the riser following disconnection do not pose a threat to the vessel or its crew.

Another object is to provide an offshore drilling vessel with means to transport a riser from one location to another in a safe manner during normal or inclement weather conditions, or to allow the maintenance and repair of the normal riser support mechanisms while the riser is suspended from said vessel.

A further object of the invention is to provide a riser braking apparatus which is simple in design, rugged in construction, and economical to manufacture.

The various features of novelty which characterize the invention are pointed out with particularity in the claims next to and forming a part of this disclosure. For a better understanding of the invention, its operating advantages and specific object obtained by its uses, reference should be made to the accompanying drawing and descriptive matter in which there are illustrated preferred embodiments of the invention.

BRIEF DESCRIPTION OF THE DRAWINGS

FIGS. 4, 4A are schematic representations of brake elements which carry hydraulically driven friction elements.

FIGS. 5, 5A are schematic representations of a brake element which contacts friction elements mounted on the riser.

FIGS. 6, 6A are schematic representations of a brake element with incorporated alignment and riser positioning means.

FIG. 7 is a schematic representation of latching mechanisms used to centrally position the riser and to connect the brake elements about the riser.

FIG. 8 is a schematic representation of a hydraulic prime mover means.

DESCRIPTION OF THE PREFERRED EMBODIMENT

Figure 1:
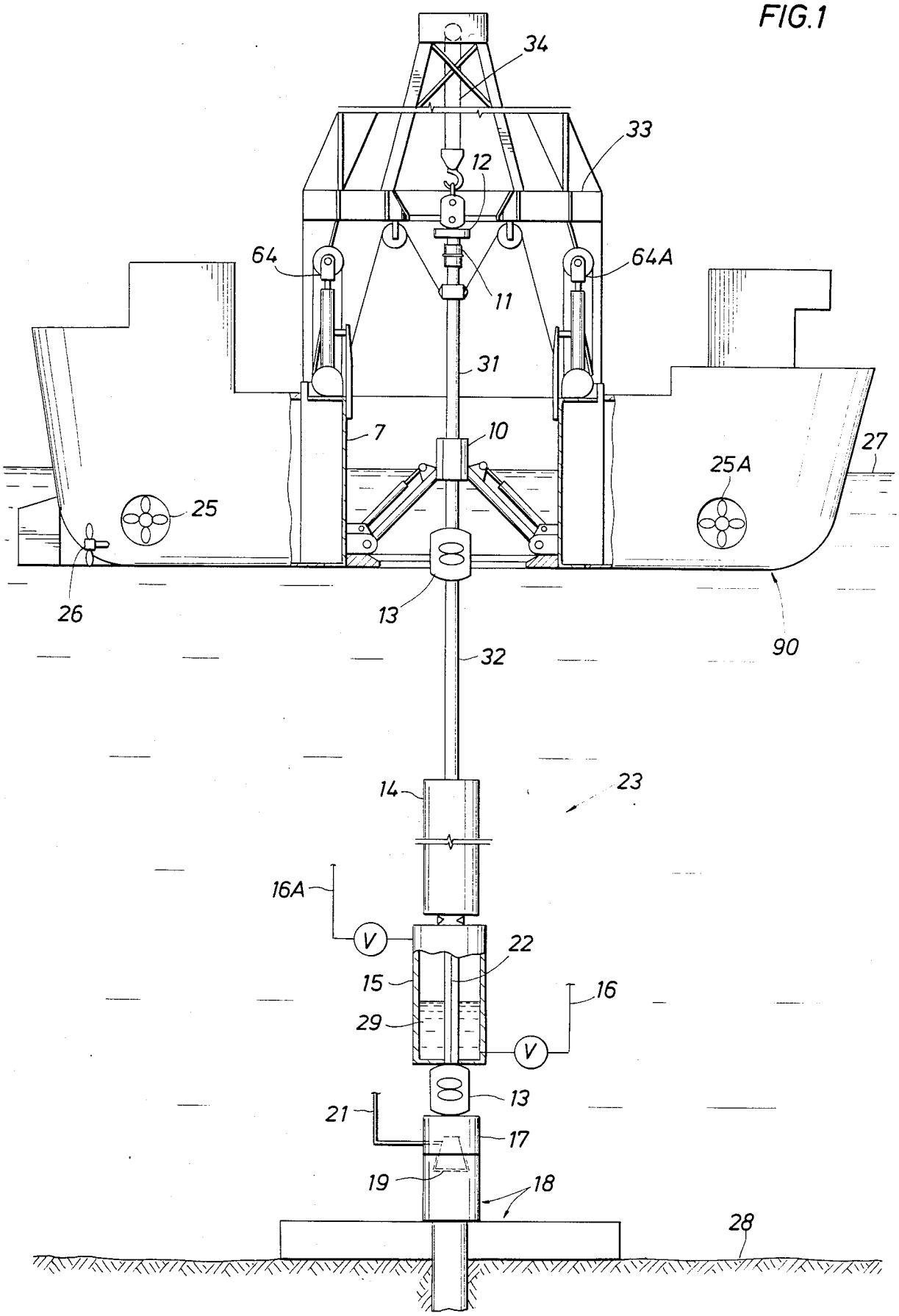
FIG. 1 is a schematic representation of the riser braking apparatus, with a riser shown positioned through the moon pool of a floating drilling vessel and secured to a wellhead assembly on the seafloor.

FIG. 1 shows an offshore drilling vessel 90 floating in a body of water 27 above the ocean floor 28 with a riser 23 connected between the ocean floor 28 and the riser motion compensating and tensioning means 64, 64A of the vessel 90. The motion compensation and tensioning apparatus 64, 64A, which is well known to the art, allows the riser 23 to move vertically in a controlled manner within the centrally positioned hull opening or "moon pool" 7 of the vessel 90, and also applies an upward force to the riser 23 in order to stabilize the riser 23 and to prevent buckling of the riser 23 while connected to a wellhead 18. Personnel positioned on the derrick floor 33 conduct drilling operations through the riser 23 down to the subsea formation located beneath the ocean floor 28, utilizing the drill string and riser lifting mechanism 34. The motion of the vessel 90 relative to the riser 23 upper elements is compensated by means of a riser inner barrel 12 which telescopically moves within the riser outer barrel 11. This movement allows the drilling operations from the derrick room floor 33 to proceed at a varying elevation from the ocean floor 28. The riser inner barrel 12 may be fully extended by upward movement of the drill string and riser lifting mechanism 34. In this fully extended position lifting forces may be applied to the upper end of the riser 23, in order to raise the riser 23 within the vessel 90.

Positioned below the upper elements of the riser outer barrel 11 is the riser braking means apparatus 10. When the riser braking means apparatus 10 is secured to the riser brake section 31, movement of the riser 23 upper elements may be stopped relative to the vessel 90. This prevents damage to the vessel or crew due to recoil movements of the riser when released from the wellhead. Furthermore, this allows the riser 23 to be suspended from the vessel and, if desired, to be transported from one location to another, such as to avoid a storm at the original location or to commence drilling or well workover and completion operations at another location. The riser 23 also may be secured beneath the floating vessel 90 from the riser braking means apparatus 10 in order to allow maintenance operations either on the riser motion compensating and tensioning means 64, 64A, or on the drill string and riser lifting mechanism 34.

The riser braking apparatus 10 may be mounted below the water line of the vessel 90. Submersion of the apparatus 10 in this manner increases the heat dissipation rate from the apparatus 10 during braking operations, and therefore permits larger braking forces to be applied.

Positioned below the riser braking apparatus 10 is a flexible coupling 13 which allows the riser 23 to bend below the bottom of the floating vessel 90 without contacting the vessel 90, during the vessel 90 movement above the wellhead assembly 18, and during riser 23 towing operations.

Below the flexible coupling 13 is a series of riser 23 sections covered externally either with syntactic foam buoyancy elements 14, or buoyancy chambers 15, or plain sections 32 with no float mechanisms. The buoyancy chambers 15 are capable of having buoyancy adjusting means or "ballast" 29 added or removed from them. Increasing the buoyancy of the riser 23 averts compressive failure of the riser 23 when connected to the wellhead assembly 18. Decreasing the buoyancy reduces the upward vertical forces or "bobbing" tendencies of the riser 23 on the riser braking apparatus 10 while the riser 23 is disconnected from the wellhead 18 but secured in position beneath the vessel 90. Buoyancy adjusting control means 16, 16A operated from the offshore vessel 90 are capable of controlling the ballast that is added or removed from the buoyancy chambers 15. A drill string 22 can also be placed within the riser 23 sections for additional ballast while the riser 23 is suspended from the vessel 90 or during towing operations of the riser 23. This drill string 22 is shown in FIG. 1 in a partial cutaway view of the riser 23 and buoyancy chamber 15. The length of the riser 23 may also be altered before commencing towing operations, by the addition or removal of riser sections 14, 15, or 32.

Another flexible coupling 13A is located below the ballasting means of the riser 23 and just above a drilling wellhead assembly 18, which allows the upper portions of the riser 23 to bend relative to the wellhead assembly 18 due to ocean currents and to surface movements of the vessel 90. Typically located below the flexible coupling 13A is the lower end of the riser 17 which incorporates a blowout preventer and associated controlling means (not shown) and a wellhead connection means 19 of any construction well known to the art, which connects or disconnects the riser 23 from the subsea wellhead assembly 18.

Directional positioning thrusters 25, 25A are incorporated below the water line of the floating vessel 90 in order to compensate for normal wind, wave and tide forces imposed upon the floating vessel 90. Vessel motive or propulsion means 26 are used for movement of the floating vessel 90 from one location to another.

Figure 2:
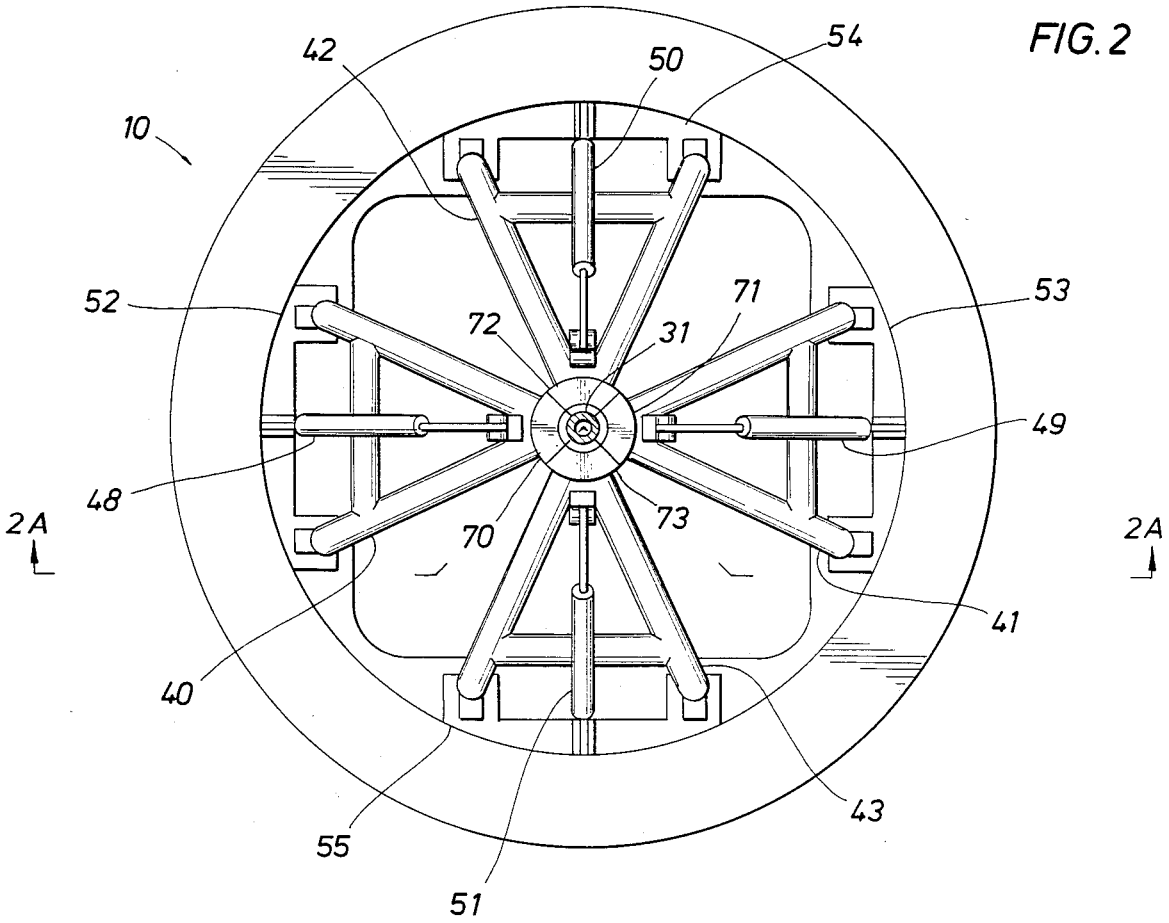
FIGS. 2, 2A are schematic representations of the riser braking apparatus shown closed about the brake section of the riser.

As shown in FIG. 2, the riser braking apparatus 10 is shown closed about the riser brake section 31. The four brake elements, respectively numbered 70, 71, 72, and 73, are shown in contact with the riser brake contact area 84 (as shown in FIG. 4) which consists of the outer elements of the riser brake section 31. Each brake element 70, 71, 72, and 73 is shown symmetrically positioned about the riser brake section 31, though it is recognized that different position combinations are possible for deploying the riser braking apparatus 10 about the riser brake section 31. It is also recognized that whereas four sections of the riser braking apparatus 10 are shown, less sections or more sections of this apparatus may be installed. In particular, two sections opposed from each other on opposite sides of the moon pool 7 of the vessel 90 may be used. Looking particularly at one brake element and beam section, it can be seen that the braking beam 40 is connected to the vessel at beam pivot 52. The braking beam 40 is also connected to the brake element 70 at the opposite end from the beam pivot 52, though it is recognized that brake element 70 need not be mounted on the end portion of braking beam 40, in order to perform effectively. Beam prime mover means 48, such as a piston and hydraulic chamber well known to the art, is shown operatively engaged between the beam pivot 52 and the braking beam 40. As can be seen, a similar configuration is used on the remaining sections which form the entire riser braking apparatus 10. For example, in viewing FIG. 2, the beam pivot 52, the beam pivot 55, the beam pivot 53 and the beam pivot 54 are all of similar construction. Each of these elements may be modified to fit within the restrictive area of the moon pool 7, as is well known in the art.

While braking beam 40 is shown in FIG. 2 as being a tripod, it is also well recognized that other beam configurations may be used to engage the braking element 70 with the riser brake section 31.

Figure 2A:
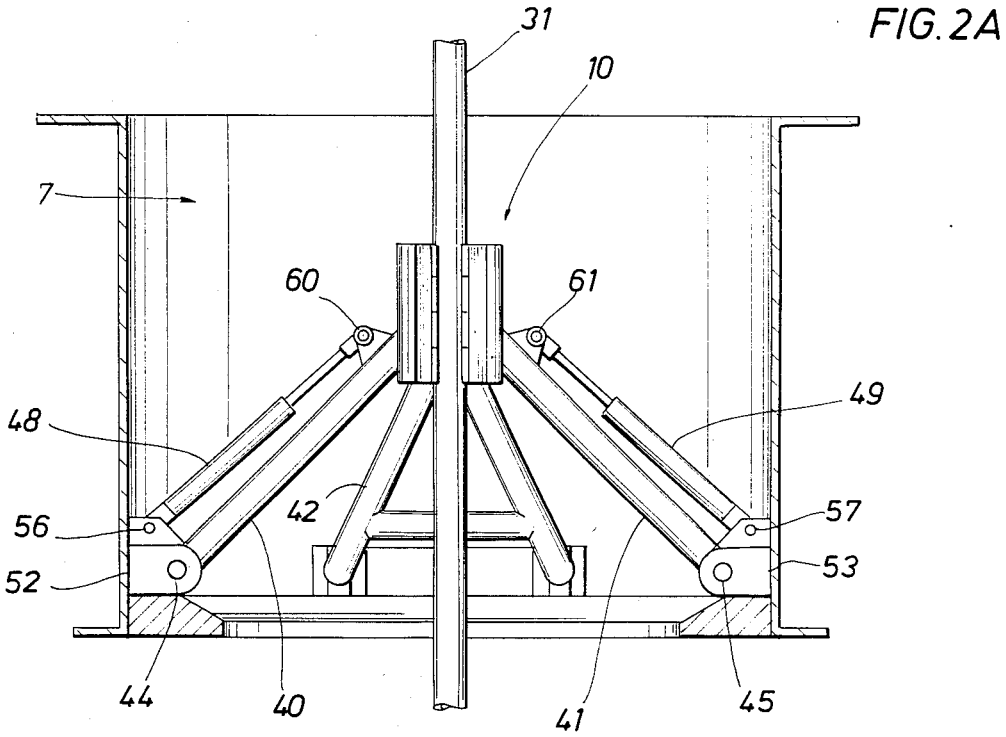

As shown in FIG. 2A, beam pivot 52 and beam pivot 53 are shown attached to relatively opposite sides of the moon pool 7 of the vessel 90. Braking beam 40 and braking beam 41 are shown pinned to beam pivot 52 and beam pivot 53 by beam pin 44 and beam pin 45, respectively. Each braking beam 40, 41, is free to rotate about each beam pin 44, 45, as is well known in the art. Positioned above each respective braking beam 40, 41 are beam prime mover means 48 and beam prime mover means 49 consisting in this embodiment of a hydraulic cylinder and piston arrangement well known to the art, though it is recognized that electrical or other mechanical prime mover means may also be used. Each prime mover means 48, 49 is pinned at its lower end by lower pin 56 in the case of beam prime mover means 48 and by lower pin 57 in the case of beam prime mover means 49. Each prime mover means 48, 49, is engaged at its upper end with the braking beam 40, 41 by upper pin 60 and upper pin 61 in the case of each respective braking beam 40, 41, as is well known to the art.

Figure 3:
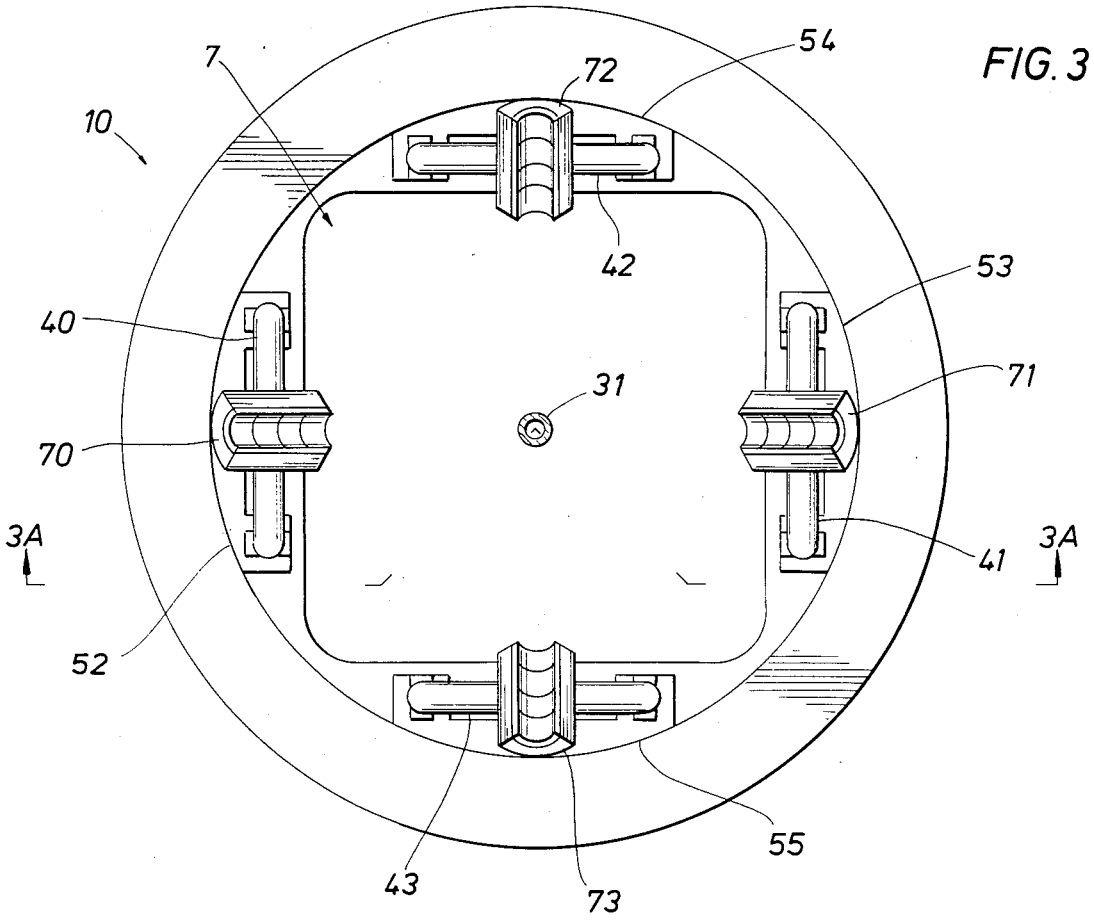
FIGS. 3, 3A are schematic representations of the riser braking apparatus shown in the retracted or stowed position.
Figure 3A:
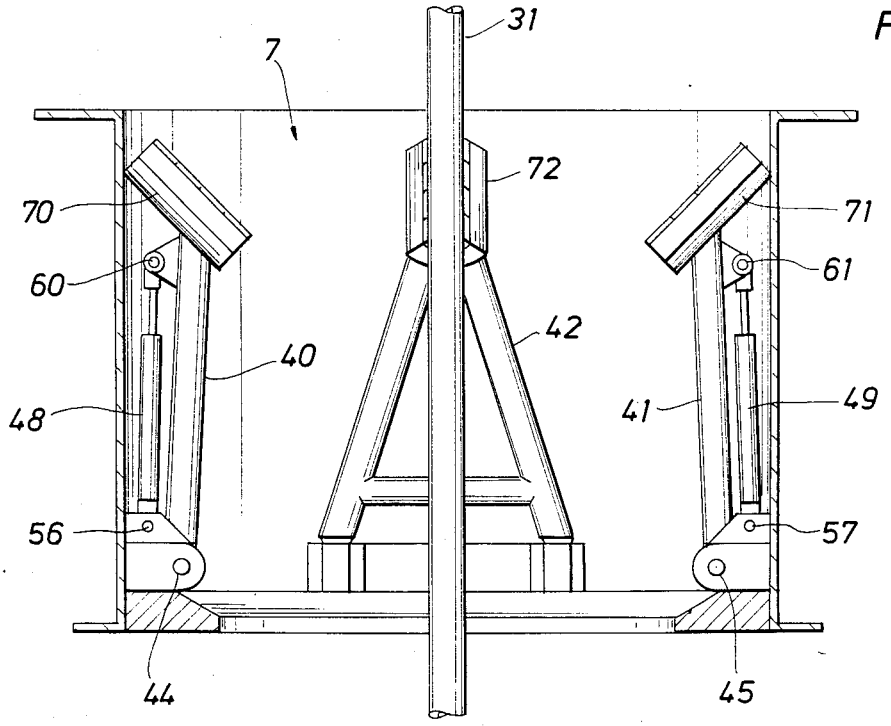

As shown in FIG. 3, the riser braking means apparatus 10 may be retracted into a stowed or deactuated position wherein each of the braking elements 70, 71, 72, 73 is shown positioned adjacent to the walls of the moon pool 7. In this secured position, maintenance may be performed on each respective brake element 70, 71, 72, 73. Considering brake element 71, it can be seen that it has rotated to its present position by pivoting the braking beam 41 upon beam pivot 53. The riser brake section 31 is shown centrally located within the moon pool 7 of the vessel 90. As can be seen more clearly in FIG. 3A, braking beam 41 has rotated to its current position about beam pin 45 by the retraction of the piston within the cylinder of the beam prime mover means 49. The other braking beams 40 and 42 are also shown in their retracted position or stowed position. Each beam may be retracted from or advanced to the riser brake section 31 individually or may be retracted or advanced as a unit, as is well known to the art.

As can be seen in FIG. 4, brake element 70 and brake element 71 consist of numerous friction elements 80 and hydraulic mechanisms 81–83 for actuating said friction element 80 against the riser brake section 31. FIG. 4 shows brake element 70 and brake element 71 in position to contact the riser brake contact area 84 portion of the riser brake section 31, (the outer element or surface of said riser brake section 31 that contacts the brake elements 70, 71 being the riser brake contact area 84). Steel on steel contact may be made at this location, or various combinations of other materials may be used to increase the coefficient of friction between the brake elements 70, 71 and the riser brake contact area 84. Friction element 80 may be similar to a "brake shoe" which has been formed, connected or mounted on the brake elements 70, 71. In the preferred embodiment friction element 80 is driven by a piston 81 which is centered within a cylinder 82. Pressurized hydraulic fluid 83 is supplied from pressurized control lines 35 to actuate the piston, as is well known to the art. Actuation of each friction element 80 results in force being applied to the riser brake contact area 84, which arrests movement of the riser brake section 31. Control valve 136 controls actuation of the friction element 80 along with other similar elements carried by brake element 70, although it is recognized that individual control valves 136 may be used to control each friction element 80 individually, in order to selectively dampen the movement of the riser brake section 31. A combination of various materials such as sintered metal may be used at this interface in order to apply proper dampening and arresting characteristics that are required to limit the movement of the riser brake section 31. The forces applied to this friction interface can be seen to be a cooperating combination of the forces applied by the hydraulic action of the braking beam's prime mover means 48, 49 and the piston 81 and cylinder 82 forces generated by pressure applied from the hydraulic fluid 83. Whereas in FIG. 4 each brake element 70, 71 carries friction elements 80, it is recognized that not all brake elements 70, 71 need carry these friction elements. For example, metal on metal contact may be employed between the brake elements 70, 71 and the contact area 84, though the contact surfaces should be replaceable after a certain amount of wear has occurred.

As can be seen in FIG. 4A, the piston 81, cylinder 82, and friction element 80 can all be incorporated within the brake element 70. The modular concept of the preferred embodiment allows easier replacement of each selective friction element 80 whenever required. As can be seen each friction element 80 comes into contact with a corresponding portion of the riser brake contact area 84, the riser brake contact area 84 being mounted upon or incorporated with the outer elements or surface of the riser brake section 31. In the simplest case, the riser brake contact area 84 would comprise the outer elements or surface of the riser brake section 31, or brake material may be laminated upon the outer surface of the riser brake section 31, for example.

Other alternative embodiments of the present apparatus may be used to accomplish the same mechanical effect, as can be seen in FIG. 5. The riser brake contact area element 117 is shown mounted on the outer surface of the riser brake section 31. Riser brake contact area element 117 is connected to riser brake contact area element 116 by connection means 118 as is well known to the art, for example, such as a series of nuts and bolts securedly engaged through a mating flange. As can be seen, the braking beam 110 carries brake element 113, which contacts riser brake contact area element 117. The friction generated between these two elements, 113 and 117, provides damping of the oscillations of the riser brake section 31. It is also recognized that the brake element 113 may be fabricated to contact directly with the riser brake section 31 whereupon steel elements forming a portion of the brake element 113 will contact directly with steel elements forming the outer surface of the riser brake section 31.

As can be seen in FIG. 5A, the brake element 113 is shown being driven by the braking beam 110 in the direction of the arrow toward the riser brake section 31. Alternative configurations of the braking beam 110 may be utilized depending upon the space available within the moon pool 7 of the vessel 90.

As shown in FIG. 6, the braking beam 111 is connected by an upper pin 92 to the brake element 112 which carries the riser positioning means 98. The riser positioning means 98 are formed from steel plate elements attached to the lower portion of the riser positioning means 98. These riser positioning means 98, in operation, assist in positioning and centering the riser brake section 31 (FIG. 5A), within the brake element 112, as the brake element 112 closes about the riser brake section 31.

As seen in FIG. 6A the brake element 112 may pivot about upper pin 92. The pivot of this brake element 112 about the upper pin 92 at an angle 96, allows the brake element 112 to compensate for initial misalignment of the riser brake section 31. Excess pivot movement of the brake element 112 is prevented by movement limiting means, such as landing shoulder 94 or landing shoulder 95, as is well known in the art. As shown in FIG. 6A, the riser positioning means 98 are located at the lower elements of the brake element 112 section, though it is recognized that they may be located at the top or middle of the brake element 112. It should be noted that whereas in FIG. 6A and FIG. 6, only one riser positioning means 98 device has been shown, the other brake elements may carry other riser positioning means 98 of a nature suitable to properly position the riser brake section 31 (FIG. 5A). Alternative riser positioning means 98 may be placed approximately in the center of the brake element 112 in order to help capture and centralize the riser brake section 31 at that location.

As shown in FIG. 7, the preferred embodiment incorporates four brake elements 100, 101, 102, and 103, respectively, although it is recognized that another number of brake elements 100, 101, 102, 103 may be used, such as two placed on opposite sides of the moon pool 7 of the vessel 90 (not shown). A pair of latch arms 105 and 107, are shown located between adjacent sides of brake element 100 and brake element 103, with similar latch arms located between the other brake elements 101 and 102. Latch arm 105 contacts latch pin 106 when brake element 100 comes in close proximity to brake element 103. Whereas in an alternative embodiment, only one latch arm 105 may be used to secure the side of each brake element 100 and 103 together, in the preferred embodiment, an additional latch arm 107 contacts latch pin 108 of brake element 100. Double latching of this nature increases the strength reliability of the latching operation.

In operation, the brake elements 100, 101, 102 and 103 are actuated and begin their movement toward the center of the moon pool. As the brake element 100, for example, travels toward the center of the moon pool, the latch arms 105, 137 on either side of the brake element 100 may contact the riser brake contact area 84 of the riser brake section 31 and thereby centralize the riser brake section 31 within the other three respective brake elements 101, 102, and 103. In other words, the latch arms 105, 137 act as riser positioning means and also latch the brake elements 100, 101, 102, 103 together. Once all of the brake elements 100, 101, 102, and 103 are latched to one another, a unitized structure is formed which encircles the riser brake section 31. Hydraulic pressure is then applied, for example, to friction element 109, which causes the friction element 109 to move in the direction of the arrow and to come into contact with the riser brake contact area 84 of the riser brake section 31. Other brake element friction elements 87, 88, 89, carried by each brake element 100, 101, 102, 103, are actuated, in order to symmetrically apply friction forces about the periphery of the riser brake section 31.

After the friction forces are applied about the periphery of the riser brake section 31 the riser 23 is disconnected from the wellhead assembly 18. Vertical oscillations are thereafter dampened by continued and perhaps by increasingly strong application of friction between the brake section 31 and friction elements 109, 87, 88, and 89, until all movement of the upper elements of the riser 23 relative to the vessel 90 is arrested.

Of course if the riser 23 is inadvertently separated from the wellhead assembly 18 before the actuation of the riser braking apparatus 10, the apparatus 10 will then be actuated. Selective movement of each braking beam 40, 41, 42, and 43 (FIG. 2) will center the riser 23 within the moon pool. Further movement will result in friction forces being applied to the riser brake section 31, with resultant damping and eventual stoppage of vertical oscillations of the riser 23. The amount of force applied to the riser 23 will of course vary the rate of damping of the movement of the riser section 31 relative to the vessel 90.

It is recognized in alternative embodiments that only one brake element need carry friction elements, in order to apply the final restraining forces required to secure the riser 23 to the vessel 90. Of course, if the apparatus as shown in FIG. 5A is used, no friction elements 109, 87, 88, 89 need be carried by the brake elements. In the FIG. 5A apparatus the forces required to arrest the riser 23 are provided by the braking beam 110 prime mover means (not shown).

Heat generated during the damping of the vertical oscillations of the riser brake section 31 may be absorbed by the body of water 27 (FIG. 1) if the brake element friction elements 109, 87, 88, 89 are mounted below water level.

Once the movement of the riser brake section 31 has ceased, hydraulic pressure will continue to be applied to the friction elements 109, 87, 88, 89, in order to effectively lock the upper elements of the riser 23 (as shown in FIG. 1) to the vessel 90.

The operation of the beam prime mover means 48 is shown in FIG. 8. The pressure source means 124 supplies alternate sources of pressure to alternate sides of the movable piston 122. Alternate movement of the movable piston 122 correspondingly moves the rod means 123 in alternate directions thereby moving the braking beam 120 in alternate directions. In FIG. 8, the hydraulic cylinder housing member 121 is shown attached to the vessel 90. It is recognized that this hydraulic cylinder housing member 121 may be operatively connected to any convenient structure, such as the beam pin 44 of the beam A pivot 52, as shown in FIG. 2A, or any other part of the vessel 90. The rod means 123, though shown connected to the brake element 119, can also be connected to the braking beam 120.

Many other variations and modifications may be made in the apparatus and techniques hereinbefore described, both by those having experience in this technology, without departing from the concept of the present invention. Accordingly, it should be clearly understood that the apparatus and methods depicted in the accompanying drawings and referred to in the foregoing description are illustrative only and are not intended as limitations on the scope of the invention.

What is claimed is:

1. For use in a floating vessel having a substantially centrally-positioned vertical hull opening therethrough, said vessel being provided with well drilling equipment, including an elongated vertical riser provided with a riser brake contact area carried outwardly near the upper end thereof, said riser extending in tension down through said hull opening to a point adjacent the ocean floor, and motion-compensating and tensioning means carried by said vessel operatively connected to said riser for vertically supporting said riser during normal operations, the invention comprising riser braking means apparatus carried by said vessel substantially within the hull opening through the vessel, said braking means apparatus comprising:

brake element means carried by said vessel operatively engaged between said vessel and said riser brake contact area to arrest and prevent further movement of said riser upper end relative to said vessel; and brake element means prime mover means operatively connected between said vessel and said brake element means, for moving said brake element means.

2. The apparatus of claim 1 wherein the brake element means further comprises:

at least two beam pivot means arranged in spaced relationship on opposite sides of and within said hull opening and being connected to said vessel;

at least a pair of braking beams, each one operatively engaged with one of said beam pivot means, each braking beam positioned to span opposite portions of said hull opening and being movable toward each other; and at least one brake element carried by each of said beams, said brake element being engageable with at least a portion of said riser brake contact area.

3. The apparatus of claim 2 wherein each braking beam is movable relative to said beam pivot means.

4. The apparatus of claim 3 wherein said beam pivot means includes a beam pin wherein each braking beam is rotatably engaged with said beam pin, said beam pin being secured by said beam pivot means.

5. The apparatus of claim 4 wherein said beam pin is positioned in a horizontal plane by said beam pivot means to allow said braking beam to pivot about said beam pin in a vertical plane.

6. The apparatus of claim 3 wherein each braking beam rotates equally toward and away from each other about said beam pivot means.

7. The apparatus of claim 6 wherein each braking element, when in closest proximity to one another, is in closest proximity to said riser brake contact area location.

8. The apparatus of claim 2 wherein the brake element carried by each of said braking beams is carried adjacent to one end of said braking beam, the other end of said braking beam being operatively engaged with said beam pivot means.

9. The apparatus of claim 8 wherein said brake element further comprises:

movable engagement means operatively connected between said end of said braking beam and said brake element means;

movement limiting means formed by cooperating elements of said braking beam and said brake element, to limit rotation of said brake element about said end of said braking beam;

at least one hydraulically actuated friction element carried by said brake element which engages with a portion of the riser brake contact area to arrest movement of said riser brake contact area relative to said brake element; and at least one latch arm means carried by said brake element to latch and secure at least on adjacent brake element to said brake element.

10. The apparatus of claim 2 wherein the brake element includes at least one friction element which engages with a portion of the riser brake contact area.

11. The apparatus of claim 10 wherein the brake element includes at least one friction element prime mover means for actuation of at least one friction element.

12. The apparatus of claim 10 wherein the brake element further comprises latch arm means carried by each brake element, operatively engaged with at least one adjacent brake element, to latch and secure at least one brake element to at least one adjacent brake element.

13. The apparatus of claim 2 wherein the brake element further comprises latch arm means carried by each brake element, operatively engaged with at least one adjacent brake element, to latch and secure at least one brake element to at least one adjacent brake element.

14. The apparatus of claim 2 wherein the brake element comprises steel plate element means which engage with a portion of the riser brake contact area.

15. The apparatus of claim 2 wherein the brake element further comprises:

steel plate element means which engage with a portion of the outer elements of the riser brake contact area; and at least one friction element which engages with a portion of the riser brake contact area.

16. The apparatus of claim 15 wherein the brake element includes at least one friction element prime mover means for actuation of at least one friction element.

17. The apparatus of claim 2 wherein said brake element is movably connected to said braking beam, to allow for misalignment of said riser brake contact area with said brake element during initial contact of said brake element with said riser brake contact area.

18. The apparatus of claim 16 including movement limiting means engageable between said brake element and said braking beam for limiting movement of said brake element relative to said braking beam.

19. The apparatus of claim 2 wherein said brake element includes riser positioning means affixed thereto to centrally position said riser within said hull opening.

20. The apparatus of claim 19 wherein said riser positioning means comprises plate element means carried by said brake element, said riser positioning means having a semi-circular opening of diameter greater than said riser brake contact area, located face to face with said riser brake contact area to position said riser brake contact area adjacent said brake element.

21. The apparatus of claim 19 wherein said riser positioning means comprises latch arm means operatively engaged with said brake element, said latch arm means located face to face with said riser brake contact area to position said riser brake contact area adjacent said brake element.

22. The apparatus of claim 2 wherein the brake element means further comprises hydraulic piston and cylinder prime mover means operatively connected between said vessel and said brake element means for selectively moving said brake element means.

23. The apparatus of claim 22 wherein the hydraulic piston and cylinder prime mover means further comprises:

at least one hydraulic cylinder having a housing member operatively attached to said vessel;

a movable piston dividing the housing member into two hydraulic chambers;

rod means connected to said piston and coupled to said braking beam of said braking element means; and pressure source means operatively connected to said hydraulic chambers for moving said braking beam in alternate directional modes in response to pressurization of alternate hydraulic chambers by said pressure source means.

24. The apparatus of claim 23 wherein said hydraulic cylinder comprises a housing member operatively attached to at least one of said beam pivot means.

25. The apparatus of claim 23 wherein said rod means is connected to said piston and coupled to said braking element of said braking element means.

26. The apparatus of claim 2, wherein at least one brake element which engages a portion of said riser brake contact area comprises steel plate element means, to arrest movement of said riser brake contact area relative to said brake element.

27. The apparatus of claim 2 wherein at least one brake element which engages a portion of said riser brake contact area comprises at least one friction element carried by said brake element, to arrest movement of said riser brake contact area relative to said brake element.

28. A method of arresting and preventing further movement of the elements forming the upper end of a riser relative to a floating vessel therethrough, said vessel being provided with well drilling equipment including a derrick with associated drill string lift equipment, an elongated vertical riser provided with a riser brake contact area carried outwardly near said riser upper end thereof, a wellhead connector carried at the lower end of said riser and secured to a wellhead assembly, and adjustable buoyancy means formed with the submerged portion of said riser, said riser extending in tension during normal operations down through said hull opening to a point adjacent said wellhead assembly located adjacent the ocean floor, said vessel carrying motion-compensating and tensioning means operatively connected to said riser upper elements for vertically supporting said riser during normal operations, and provided with riser braking means apparatus, said apparatus including at least one pair of brake elements carried by braking beams operatively connected to said vessel, said method comprising:

moving said brake elements toward said riser brake contact area;

engaging said brake elements with said riser brake contact area in order to dampen, arrest, and prevent further movement of said riser upper elements relative to said floating vessel; and remotely disconnecting the wellhead connector at the lower end of said riser from said wellhead assembly.

29. The method of claim 28 wherein the step of moving said brake elements toward said riser brake contact area includes the steps of:

actuating said floating vessel riser motion compensating and tensioning means, and said drill string lift equipment, thereby:

positioning riser brake contact area generally adjacent said riser braking means apparatus carried by said vessel;

moving said brake elements of said riser braking means apparatus toward said riser brake contact area;

contacting riser positioning means carried by said brake elements with said riser brake contact area; and positioning said brake elements adjacent said riser brake contact area.

30. The method of claim 29, including the steps of adjusting the buoyancy of said riser by adding and removing adjustable buoyancy means from said riser.

31. The method of claim 28 wherein the step of engaging said brake elements with said riser brake contact area to arrest and prevent further movement of said riser upper elements relative to said floating vessel, where at least one brake element carries at least one hydraulically actuated friction element, and at least one brake element carries at least one latching arm means, includes the steps of:

latching at least one brake element to at least one other brake element;

actuating at least one friction element, thereby;

driving at least one friction element into contact with said riser brake contact area.

32. The method of claim 28, including the steps of:

transporting said floating vessel with said securedly arrested riser to another location;

moving said brake elements away from said riser brake contact area to disengage said brake elements from said riser brake contact area;

adjusting height of the riser for connection to a second wellhead assembly;

lowering said riser onto said wellhead assembly; and connecting riser wellhead connector to said wellhead assembly.

33. The method of claim 28, including the step of suspending said riser beneath said floating vessel.

34. The method of claim 33, including the step of suspending said riser beneath said floating vessel during repair and maintenance operations on said vessel's motion compensating and tensioning equipment which normally supports and tensions said riser.

35. Apparatus for arresting the movement of the upper end of a riser relative to a floating vessel which carries said riser within a vertical hull opening therein, said upper end of said riser provided with a riser brake contact area, said apparatus comprising:

riser braking means apparatus carried by said vessel substantially within the hull opening through the vessel for damping, arresting, and preventing further movement of the upper end of the riser relative to the vessel, said riser braking means apparatus being operatively connectable between said vessel and said riser.

36. The apparatus of claim 35, said riser braking means apparatus comprising:

brake element means carried by said vessel operatively engaged between said vessel and said riser brake contact area to dampen, arrest, and prevent further movement of said riser upper end relative to said vessel; and brake element means prime mover means operatively connected between said vessel and said brake elements means, for selectively moving said brake element means.

37. The apparatus of claim 36 wherein the brake element means further comprises:

at least two beam pivot means arranged in spaced relationship on opposite sides of and within said hull opening and being connected to said vessel;

at least a pair of braking beams, each one operatively engaged with one of said beam pivot means, each braking beam positioned to span opposite portions of said hull opening, and being movable toward each other; and at least one brake element carried by each of said beams, said brake element being engageable with at least a portion of said riser brake contact area.

* * * * *